US005752488A

United States Patent [19]

Hattori et al.

[11] Patent Number: 5,752,488

[45] Date of Patent: May 19, 1998

[54] METHOD OF CONTROLLING START OF ENGINE AND DEVICE FOR CARRYING OUT THE SAME

[75] Inventors: Kenichi Hattori, Seto; Yoshihiro Matsubara, Yokkaichi, both of Japan

[73] Assignee: NGK Spark Plug Co., Ltd., Nagoya, Japan

[21] Appl. No.: 762,148

[22] Filed: Dec. 9, 1996

[30] Foreign Application Priority Data

Dec. 15, 1995 [JP] Japan ..... 7-347718

[51] Int. Cl.[6] ..... F02D 41/06

[52] U.S. Cl. ..... 123/491; 123/179.5; 123/179.16

[58] Field of Search ..... 123/179.16, 179.17, 123/491, 179.5, 424

[56] References Cited

U.S. PATENT DOCUMENTS 4,329,951 5/1982 Seilly ..... 123/491 X 5,179,923 1/1993 Tsurutani et al. ..... 123/491 X 5,632,238 5/1997 Furukawa et al. ..... 123/179.16 X

*Primary Examiner*—Tony M. Argenbright

*Attorney, Agent, or Firm*—Foley & Lardner

[57] ABSTRACT

A method of controlling start of an internal combustion engine is provided. By the method, supply of fuel and ignition are suspended at the beginning or initial stage of cranking and started for the first time when a cranking speed has become a predetermined value. In a modified embodiment, a time elapsing from the starting of the cranking is measured, and supply of fuel and ignition are started when the time elapsing from the staring of the cranking has become a predetermined value, though the cranking speed does not become the predetermined value. The predetermined value can be altered depending upon battery voltage and coolant temperature. A device for carrying out the method is also provided.

14 Claims, 10 Drawing Sheets

METHOD OF CONTROLLING START OF ENGINE AND DEVICE FOR CARRYING OUT THE SAME

BACKGROUND OF THE INVENTION

1. Field of the Invention

The present invention relates to a method of controlling start of an internal combustion engine. Further, the present invention relates to a device for carrying out such a method.

2. Description of the Related Art

Heretofore, in an internal combustion engine for automotive vehicles or the like, it is a matter of common knowledge to perform supply of fuel and ignition from the beginning of cranking irrespectively of whether the engine is hot or cold at the time of start.

In the meantime, the cranking speed at cold start of the engine is generally lower than that at hot or warm start for the reason that the battery voltage is liable to become lower at cold start due to a higher viscosity of engine oil and a larger load for driving a starter, causing the pressure in the combustion chamber to become higher than usual. This can be explained as follows. When starting the engine, it is a usual practice not to open the throttle so much. So, when the cranking speed is high, supply of air is liable to become insufficient and a lower pressure is caused in the inlet manifold. This is accompanied by insufficient supply of air to the inside of the engine cylinders, thus causing the pressure in the combustion chamber to become lower. On the contrary, when the cranking speed is low, sufficient supply of air can be attained, so that the amount of air supplied to each cycle is large, thus causing the pressure within the intake manifold to become higher as compared with that at high cranking speed and increase up to the level near the atmospheric pressure whilst allowing the pressure within the combustion chamber to become higher correspondingly.

A high combustion chamber pressure generally causes the discharge voltage which is required to obtain spark discharge across a normal spark gap of a spark plug, to become higher. Further, a low combustion chamber pressure and a low temperature of a spark plug are causative of making the discharge voltage of the spark plug become higher. A high discharge voltage is liable to cause so-called flashover, leakage or the like defective discharge. In this instance, if the insulation resistance of the spark plug is low, such a tendency is more pronounced. When fuel is supplied under such circumstances at cranking and effective spark discharge is not obtained, there may occur such a case in which fuel is liable to stick to the igniting portion of the spark plug to cause so-called wet fouling of a spark plug. Since wet fouling of a spark plug makes it difficult for the plug to perform spark discharge of itself, improvements on this matter are desired.

SUMMARY OF THE INVENTION

According to an aspect of the present invention, there is provided a novel and improved method of controlling start of an internal combustion engine. The method comprises the steps of detecting a coolant temperature of the engine, detecting a cranking speed at start of the engine, and suspending supply of fuel to the engine, when the coolant temperature is equal to or lower than a predetermined value, until the cranking speed becomes a predetermined value.

By suspending supply of fuel until the cranking speed becomes a predetermined value at start (i.e., cranking) of the engine at low temperature, it becomes possible, at the time of cranking in which it is hard to obtain effective spark discharge, to prevent deterioration of insulation resistance, which is caused by fuel in a state of being not completely atomized, attaching or sticking to an insulator of a spark plug. By suspending supply of fuel until a condition in which proper spark discharge of a spark plug can occur is obtained due to increase of the cranking speed to some extent, and accordingly due to decrease of the pressure within the combustion chamber, rising of the temperature in the combustion chamber and of the spark plug, and falling of the viscosity of oil, it becomes possible to make it hard to occur the above described wet fouling or the like and it becomes possible to start engine at low temperature with ease.

In the meantime, during the time when supply of fuel is suspended at the beginning or initial state of cranking, the ignition system can be operated in timed relation to the cranking. It is, however, desirable to execute spark discharge or firing of the spark plug after supply of fuel is started.

Further, though the engine speed at which supply of fuel is started (i.e., engine speed for starting of supply of fuel) is set to a predetermined value as described above, there can occur such a case in which the cranking speed does not exceed the predetermined engine speed due to a severe engine starting condition or the like in which the cranking speed is hard to become higher due to a high viscosity of engine oil at extremely low temperature and due to a case the battery voltage is low and the starter cannot produce a sufficiently large driving force. By consideration of this fact, when, for example, the engine coolant temperature is lower than a standard level or the battery voltage is lower than usual, the predetermined engine speed can be adjusted to a lower value correspondingly. By this, it becomes possible to adjust the cranking speed at which supply of fuel is started to an optimum value in response to variations of the coolant temperature, battery voltage, etc., whereby more delicate control at cold start of the engine can be obtained.

Further, in order to cope with such a case in which the cranking speed does exceed the predetermined engine speed under severe engine start circumstances such as extremely low temperature or under the circumstances in which the battery is deteriorated more than detected, measurement of a time can additionally be performed. That is, when a predetermined time has elapsed from the starting of the cranking, supply of fuel is started even if the cranking speed has not yet become the predetermined engine speed. By this, it becomes possible to prevent the cranking from being continued without supply of fuel over an undesirably long time.

In the meantime, measurement of the time from the starting of the cranking is used not only in the case where the cranking speed does not exceed the predetermined engine speed but in such a control for simply starting supply of fuel on the basis of the time elapsing from the starting of the cranking, without detecting the cranking speed. Further, the measurement of the time from the starting of the cranking enables such a control in which supply of fuel is started with a certain delay (i.e., after the lapse of a delay time) after, for example the cranking speed has exceeded the predetermined engine speed. That is, even though there occurs such a case in which the cranking speed exceeds the predetermined engine speed momentarily, such a case is judged as a kind of noise and disregarded or ignored so that by the effect of setting of the delay time, supply of fuel can be started after the cranking speed has exceeded stably and assuredly the predetermined engine speed.

According to a further aspect of the present invention, there is provided a novel and improved device for controlling start of an internal combustion engine. The device comprises coolant temperature detecting means for detecting a coolant temperature of the engine, cranking speed detecting means for detecting a cranking speed at start of the engine, fuel supplying and suspending means for supplying fuel or suspending supply of fuel to the engine, fuel supply controlling means for controlling the fuel supplying and suspending means in such a manner that supply of fuel to the engine is suspended until the cranking speed becomes a predetermined value, when the coolant temperature detected by the coolant temperature detecting means is lower than a predetermined value.

The above method and device are effective for solving the above noted problems inherent in the prior art engine start control.

It is accordingly an object of the present invention to provide a novel and improved method of controlling start of an internal combustion engine which can effectively improve the start ability of an internal combustion engine, particularly the ability of cold start of an engine.

It is a further object of the present invention to provide a novel and improved method of the above described character which can effectively prevent sticking of fuel to spark plugs, i.e., so-called wet fouling of spark plugs.

It is a further object of the present invention to provide a novel and improved device for carrying out the method of the above described character.

DETAILED DESCRIPTION OF THE PREFERRED EMBODIMENTS

Figure 1:
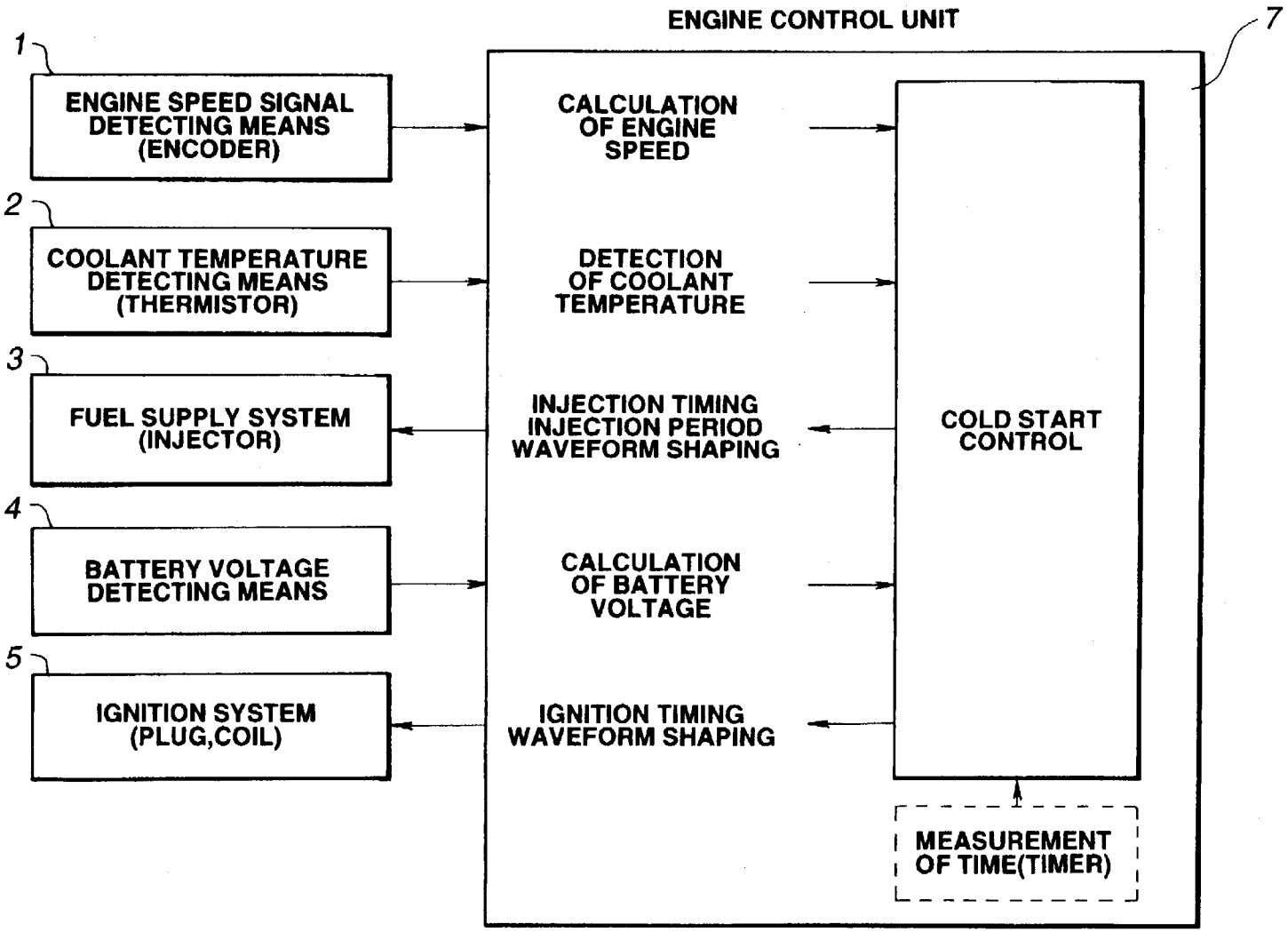
FIG. 1 is a block diagram of a device for controlling start of an internal combustion engine according to an embodiment of the present invention.

Referring first to FIG. 1, an engine control system according to an embodiment of the present invention is shown as including an engine speed signal detecting means 1 such as an encoder, an engine coolant temperature detecting means 2 such as a thermistor, a fuel supply system 3 such as an injector, a battery voltage detecting means 4 for detecting a voltage of a battery installed on a vehicle, and an ignition system 5 including a spark plug, an ignition coil, etc.

These elements 1 to 5 are connected to an engine control unit 7 so that a cold start control of an engine is executed by the control unit 7. Based on the signal from the engine speed signal detecting means 1, the cranking speed (i.e., engine speed at cranking) is calculated. Based on the signal from the coolant temperature detecting means 2, the coolant temperature is detected. Further, supplied to the fuel supply system 3 are driving signals representative of injection timing, injection period (i.e., period or time during which injection of fuel is performed, waveform shaping, etc. Based on the signal from the battery voltage detecting means 4, a battery voltage is calculated. Further, supplied to the ignition system 5 are signals representative of the timing of spark discharge (i.e., the time at which spark discharge of a spark plug takes place, a waveform representative of such spark discharge, etc. are supplied.

Figure 2:
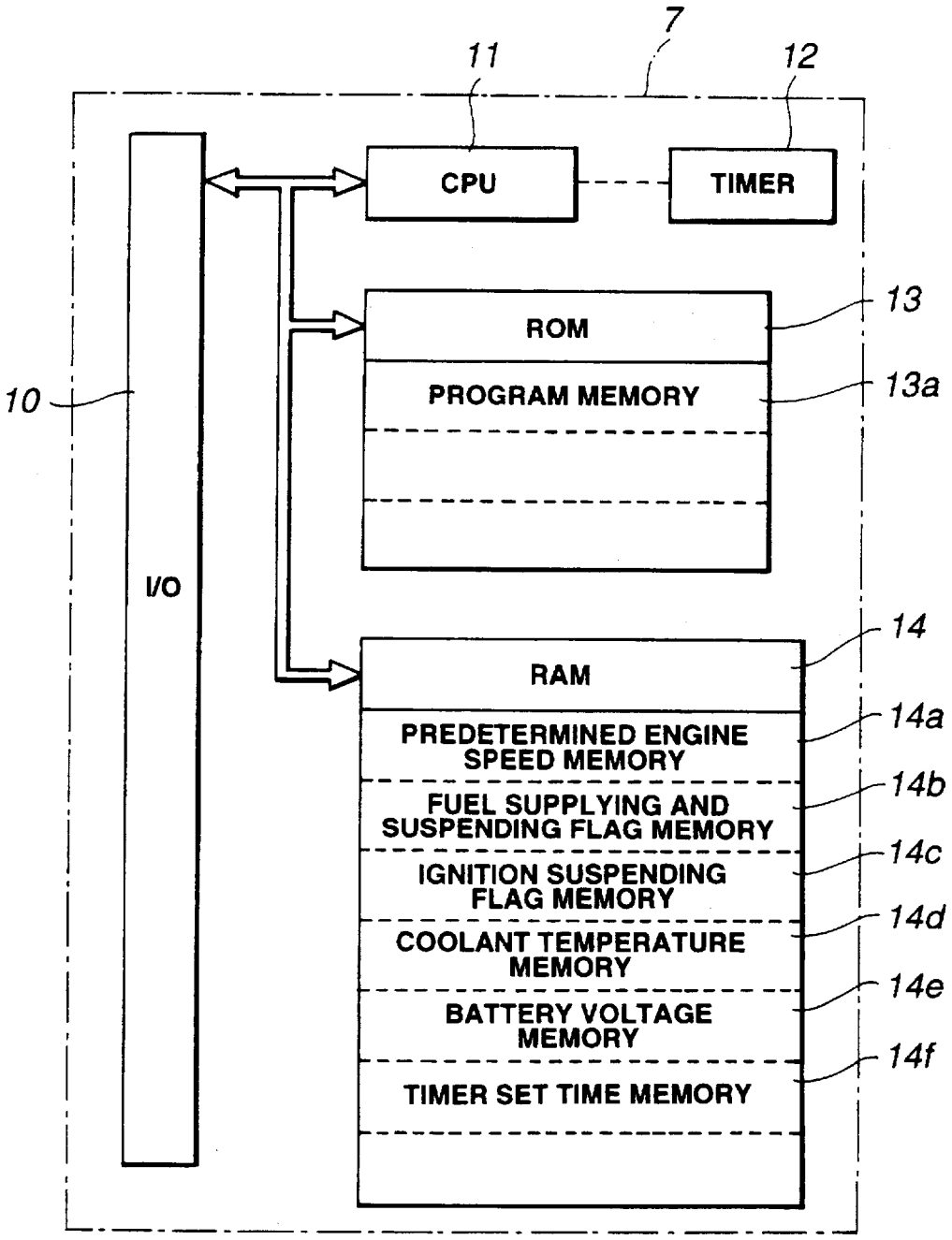
FIG. 2 is a block diagram of a more specific form of an engine control unit employed in the control device of FIG. 1.

The engine control unit 7 can be constituted by, for example, a microcomputer as shown in FIG. 2. As shown in FIG. 1, each elements 1 to 5 shown in FIG. 1 are connected to the engine control unit 7 by way of an input/output (I/O) port 10 shown in FIG. 2. A CPU (central processing unit) 11 is connected to a timer 12 which serves as a time measuring means or the central processing unit 11 of itself may be constructed to function as a timer. Assigned to a read-only memory (ROM) 13 is a program memory **13*a* storing a program for cold start control, etc. Established in a RAM (random-access memory) 14 are a predetermined engine speed memory 14*a* storing a predetermined engine speed at which supply of fuel is started during cranking, a fuel supplying and suspending flag memory 14*b* for setting a flag for instructing supply of fuel or suspension of same, an ignition suspending flag memory 14*c* for setting a flag for instructing suspension of ignition by means of a spark plug, etc., a coolant temperature memory 14*d* for temporarily storing a coolant temperature, a battery voltage memory 14*e* for temporarily storing a battery voltage, and a timer set time memory 14*f*** for temporarily storing a set time of a timer (i.e., the time set to the timer), etc.

Figure 8:
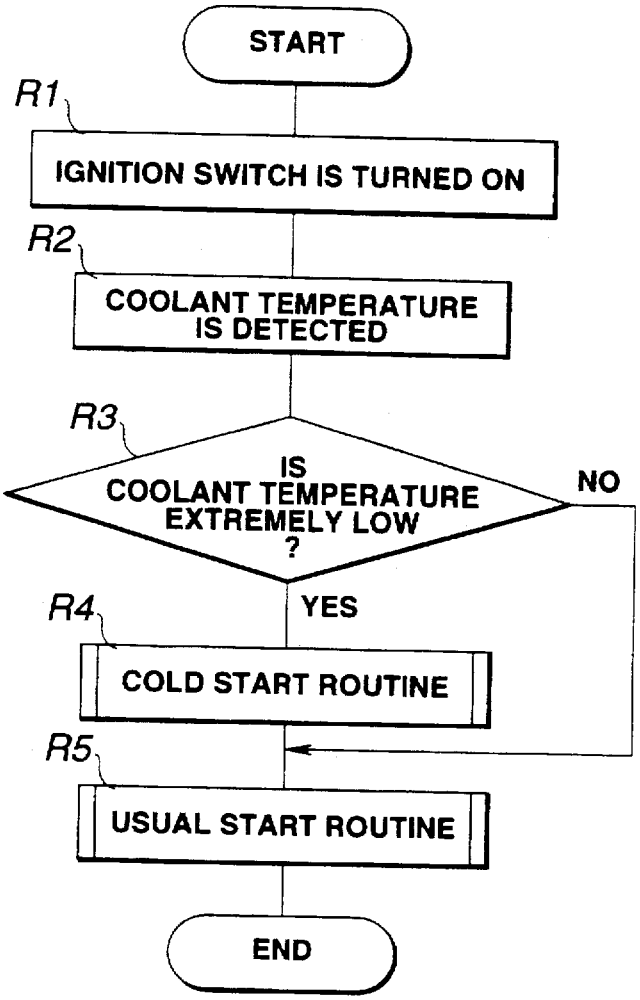
FIG. 8 is a flow chart representative of general engine start control operations executed by the control device of FIG. 1 for carrying out the engine start control of the present invention.

FIG. 8 shows a flow of control operations executed by the control device of FIGS. 1 and 2 for carrying out the engine start control of this invention. At step R1, an ignition switch of an engine (not shown) is turned on. In this instance, at step R2 an engine coolant temperature is detected. At step R3, it is determined whether the coolant temperature is in an extremely low temperature range as compared with the normal temperature (e.g., in range of 0° C. or less). When the coolant temperature is in the extremely low temperature range, the control routine at step R4 is executed or otherwise the control routine at step R5 is executed to start the engine. The control routine for normal or usual engine start is not particular one but one that is usually performed, i.e., supply of fuel and ignition are started simultaneously with the beginning or starting of cranking of the engine, so detailed description thereto is omitted for brevity. In contrast to this, in the control routine for cold start which will be described hereinafter, cranking of the engine is started after judgment on the coolant temperature at step R3 in FIG. 8, e.g., at the time of the start of the cold start control routine.

Figure 3:
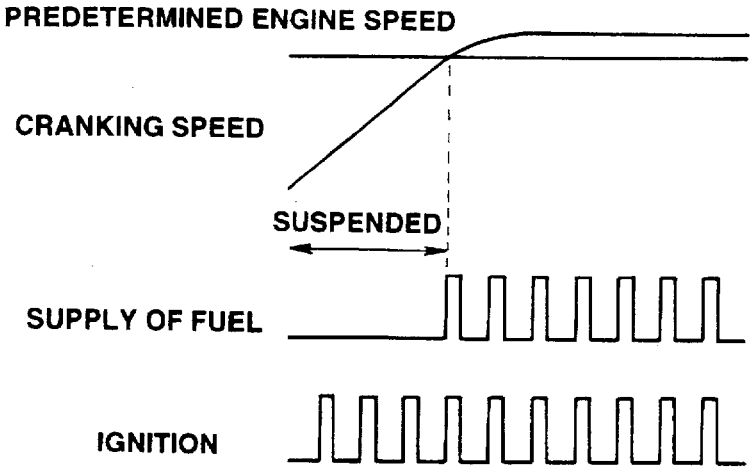
FIG. 3 is a time chart representative of an engine start control executed by the control device of FIG. 1.
Figure 9:
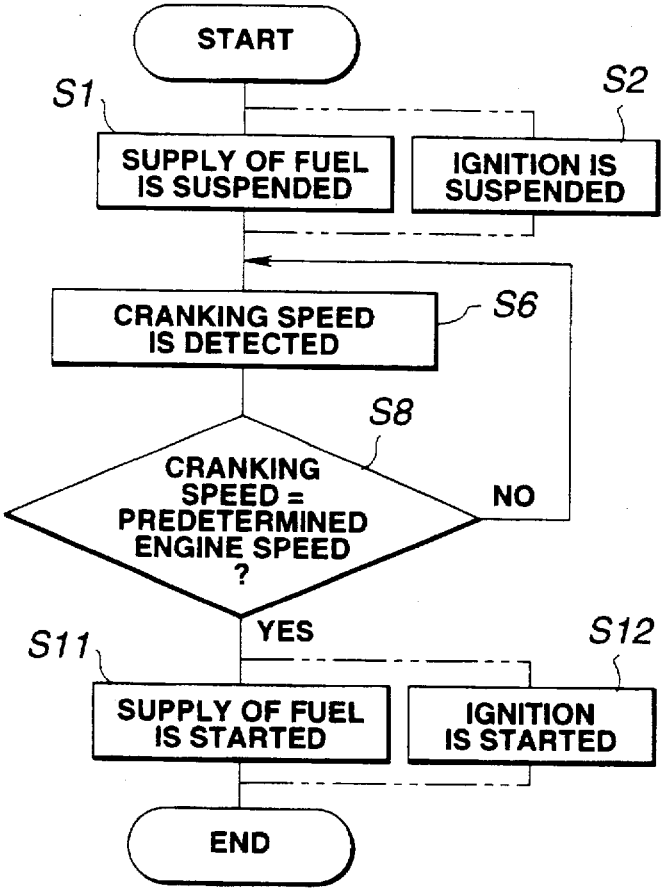
FIG. 9 is a flow chart representative of the cold start control routine of FIG. 8.
Figure 10:
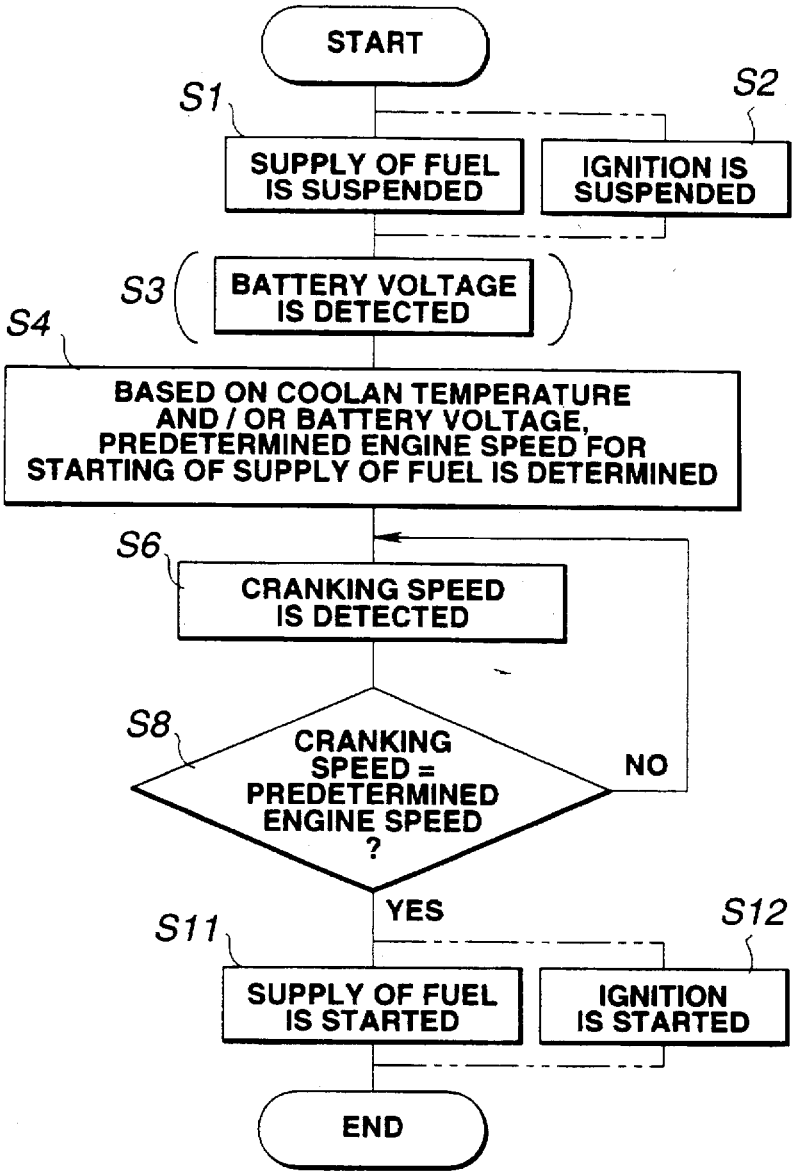
FIGS. 10 to 13 are views similar to FIG. 8 but show modifications of the cold start control routine of FIG. 9.

FIG. 3 shows an example of an engine start control which is carried out by the cold start control routine of the present invention, i.e., by the cold start control routine at the step R4 of FIG. 8. In accordance with this cold start control routine, supply of fuel is suspended until the engine speed at cranking (i.e., cranking speed) becomes a predetermined value and started for the first time when the cranking speed has become the predetermined value. FIG. 9 shows the routine for such control wherein at step S1 supply of fuel is suspended from the beginning or starting of cranking of the engine. This is attained by, for example, writing a suspension instructing flag to a fuel supply and suspension instructing flag memory **14*b* in FIG. 2, whereby the CPU (central processing unit) 11** does not give to a fuel system an instruction for carrying out injection of fuel.

At step S6 in FIG. 9, an cranking speed is detected. At step S8, it is determined whether the cranking speed becomes a predetermined engine speed. The predetermined engine speed at cranking is previously stored in the predetermined engine speed memory 14*a* in the control device of FIG. 2. When the cranking speed becomes the predetermined engine speed, supply of fuel is started at step S11.

Figure 4:
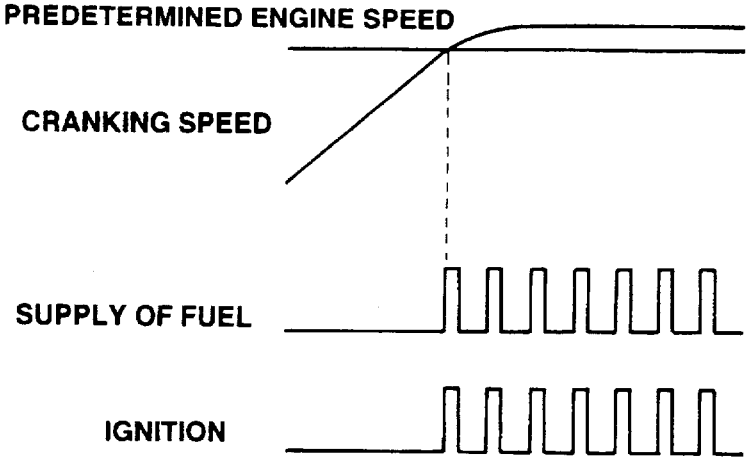
FIGS. 4 to 7 are views similar to FIG. 3 but show various modifications of the engine start control of FIG. 3.

In the meantime, it is illustrated in FIG. 3 that the ignition system is operated irrespectively of execution of supply of fuel. However, it is more desirable to suspend application of voltage than applying a high voltage to the ignition system. For this reason, such a control shown in FIG. 4 for suspending ignition until supply of fuel is started, can be employed in place therefor. This is depicted at step S2 and step S12 in FIG. 9. The control at steps S2 and S12 in FIG. 9 to 13 and the ignition suspending flag memory 14*c* in the device of FIG. 2 constitute ignition control means for control spark discharge by the ignition system 5.

Figure 5:
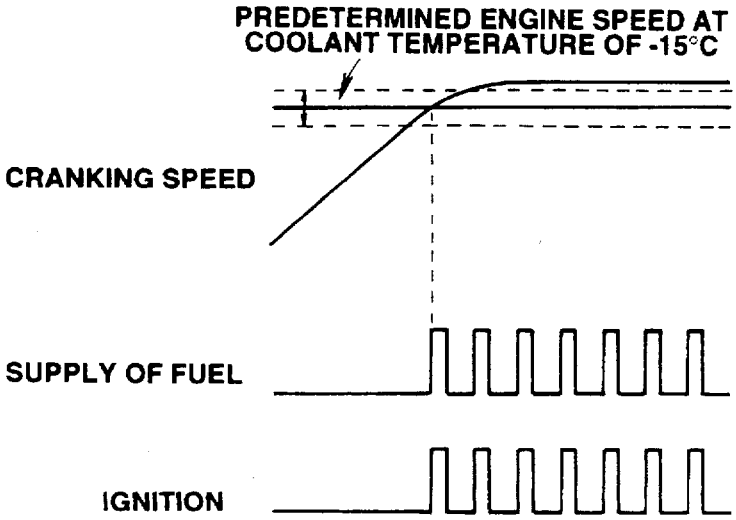

FIG. 5 shows an example of control wherein a reference engine coolant temperature is set to −15° C. and when the coolant temperature is lower than −15° C. a control is altered or modified so as to make lower the predetermined engine speed since the cranking speed is hard to become higher due to a high viscosity of oil, etc., whereas when the coolant temperature is higher than −15° C. a control is altered or modified so as to make higher the predetermined engine speed. For example, at step S4 in FIG. 10, the predetermined engine speed at which supply of fuel is started is determined on the basis of the coolant temperature and is stored in the predetermined engine speed memory 14*a* in FIG. 2. As at step S8 and onward in FIG. 10, depending upon whether the cranking speed has become the predetermined engine speed or not, it is determined to execute supply of fuel and discharge of the spark plug at step S11 and S12.

In the meantime, when the battery voltage is low due to the circumstances where the ambient temperature is extremely low or due to deterioration of the battery, there may occur such a case in which the cranking speed is hard to become higher. When this is the case, the battery voltage is detected at step S3 in FIG. 10 and temporarily stored in the battery voltage memory 14*e* in the device of FIG. 2 while the predetermined engine speed at which supply of fuel is started is determined in accordance with the battery voltage so that the predetermined engine speed can be temporarily stored in the predetermined engine speed memory 14*a*. That is, in case the battery voltage is not at a predetermined level, adjustment of the predetermined engine speed at which supply of fuel is started is made in such a manner as to make lower the predetermined engine speed. At step S6, the cranking speed is detected and it is determined to start supply of fuel and spark discharge of the spark plug depending upon the judgment or determination at step S8 as to whether the cranking speed has become the predetermined engine speed.

Further, it becomes possible to determine the predetermined engine speed at which supply of fuel is started, on the basis of both of an engine coolant temperature and a battery voltage. In this instance, since the battery voltage has been detected at step S3 in FIG. 10 while the engine coolant temperature has been detected at step R2 in FIG. 8, the predetermined engine speed at which supply of fuel is started is determined on the basis of those detected voltage and temperature. Table 1 shows an example of such control in which when, for example, the coolant temperature is minus 15° C. and the battery voltage is 12 V, the predetermined engine speed is set to 100 rpm and is adjusted to a lower value as the coolant temperature becomes lower and the battery voltage becomes lower. For example, when the coolant temperature is minus 25° C. and the battery voltage is 11V, the set engine speed is set to 80 rpm. On the contrary, when the coolant temperature is relatively high, i.e., 0° C. though included in a low temperature range, the cranking speed is easy to become higher, so there may exist such a case in which it is more effective, for the purpose of improving the starting ability of the engine, to set the predetermined engine speed to a higher value. The control at step S4 in FIGS. 10 and 11 and the predetermined engine speed memory 14*a* in the device of FIG. 2 constitute an altering means for altering a predetermined engine or cranking speed at which supply of fuel is started.

TABLE 1

| BATTERY | PREDETERMINED ENGINE SPEED (rpm) COOLANT TEMPERATURE (°C.) | | |
|---|---|---|---|
| VOLTAGE (V) | −25 | −15 | 0 |
| 11.0 | 80 | 91 | 132 |
| 11.5 | 85 | 94 | 140 |
| 12.0 | 93 | 100 | 150 |

Figure 6:
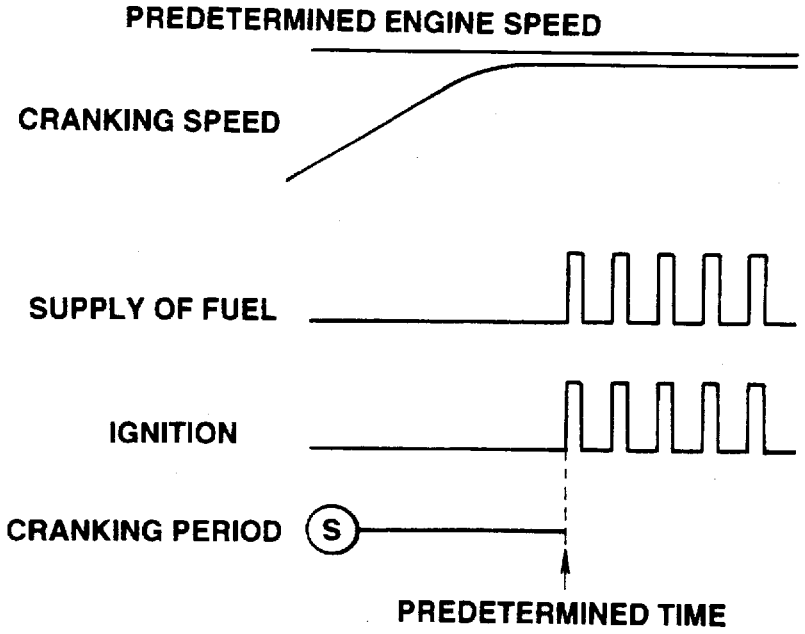

FIG. 6 shows an example of control in which when the cranking speed does not become a predetermined engine speed though a predetermined time has elapsed after the beginning of cranking, measurement of time is executed so that when a predetermined time has elapsed the lapse of the predetermined time is used as a control factor prior to others to start supply of fuel though the cranking speed has not yet become the set engine speed. The reason why the cranking speed does not become the predetermined engine speed as mentioned above, is considered, for example, due to occurrence of such a case in which the coolant temperature is extremely low or the battery voltage is low, due to occurrence of such a case in which though it is detected, during the time when cranking is not executed, that the battery voltage is at a certain level the actual battery voltage during cranking becomes lower abruptly due to deterioration of the battery, etc. so that a driving force sufficient for performing cranking of the engine cannot be obtained.

Figure 11:
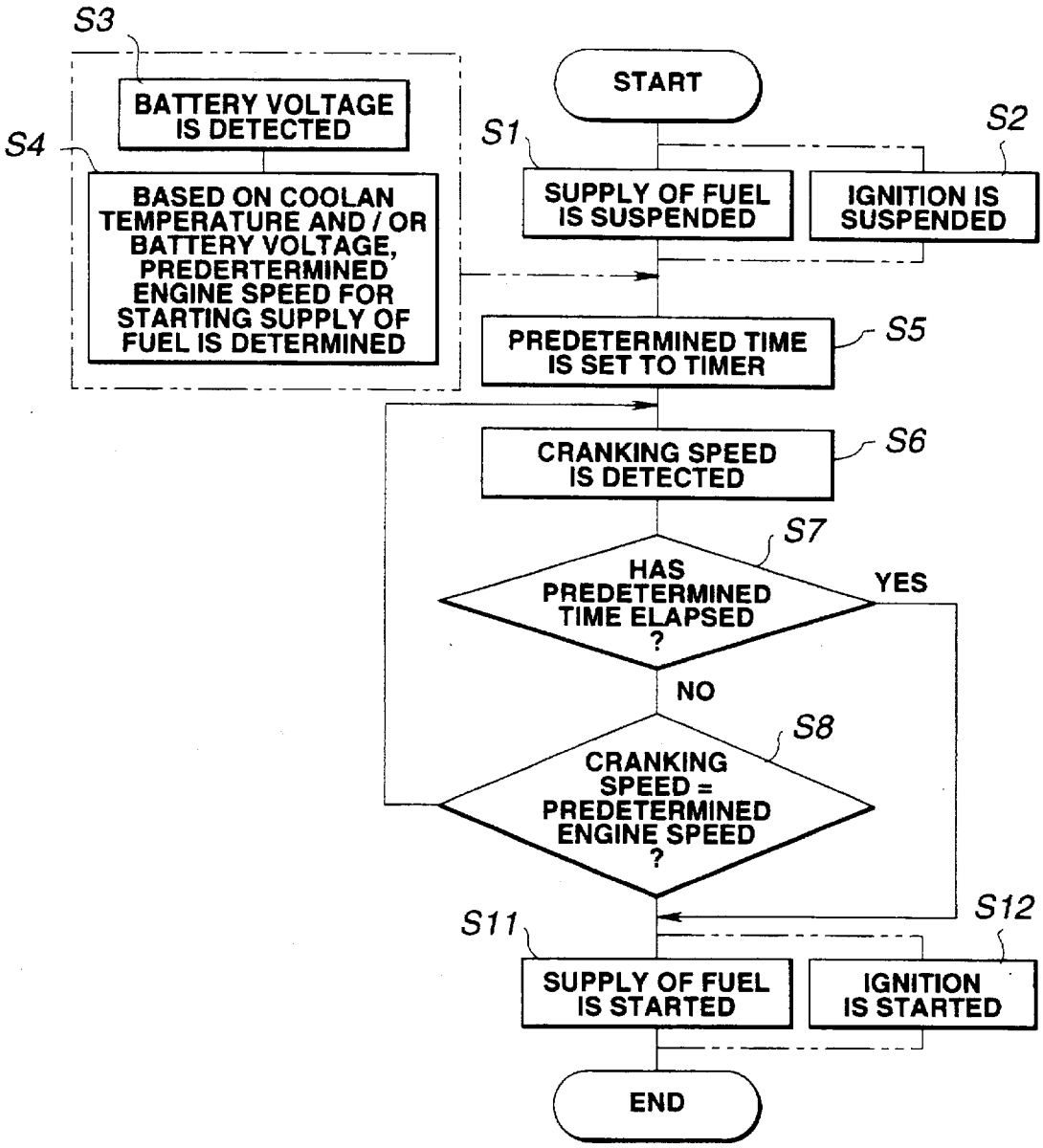

FIG. 11 shows such a control routine in which at the time when cranking of the engine is started, supply of fuel and ignition are in a condition of being suspended as at step S1 and S2. At step S5, a predetermined time is set to the timer 12 of the control device of FIG. 2. The predetermined time is determined according to the circumstances and stored in the timer set time memory 14*f* in FIG. 2. At step S6 the cranking speed is detected, and at step S7 it is determined whether the predetermined time has elapsed or not. When the cranking speed becomes the predetermined engine speed before lapse of the predetermined time, supply of fuel and ignition are started at step S11 and step S 12.

However, when the above described predetermined time of the timer has elapsed before the cranking speed becomes the predetermined engine speed, the step S8 is bypassed to execute the control at step S11 and S12. By this, even if the engine speed at cranking does not become the predetermined engine speed, supply of fuel is started after the lapse of the predetermined time, whereby it becomes possible to prevent cranking under the condition where supply of fuel is suspended from being continued longer than needed.

In the meantime, while in the control of FIG. 11 the predetermined engine speed can be determined at step S3 and step S4 as a value reflective of the coolant temperature and the battery voltage, the predetermined engine speed can be set to a fixed value, in case of this embodiment in which measurement of the time from the beginning of cranking is executed, by omitting the control at the steps S3 and S4.

Figure 7:
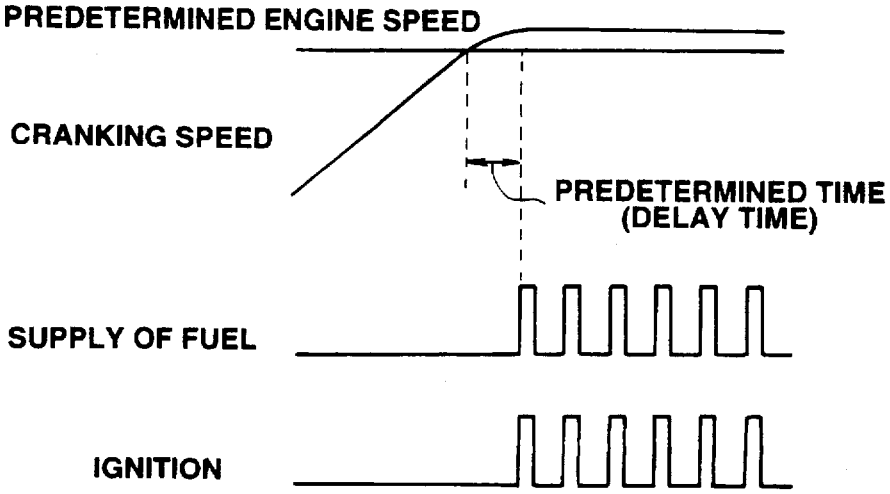

FIG. 7 shows a control in which the time measuring means is used for not starting supply of fuel and ignition immediately after the cranking speed becomes a predetermined engine speed but for starting supply of fuel and ignition after the lapse of a predetermined time, i.e., a delay time is set to start supply of fuel and ignition after lapse of the delay time. This can produce, for example, the following effect. Now, imagine such a condition in which the cranking speed has exceeded momentarily but become lower than the predetermined engine speed in a moment later, this is considered as a kind of noise and therefore it is not desirable to start supply of fuel and ignition under this condition on consideration of the purpose of control. Thus, in order that such a case in which the cranking speed exceeds momentarily the predetermined engine speed is disregarded or ignored in the control, the above described delay time is set so that after the lapse of the delay time it can be assured that the cranking speed has become the predetermined engine speed, so by executing supply of fuel thereafter it becomes possible to attain intended and stable supply of fuel.

Figure 12:
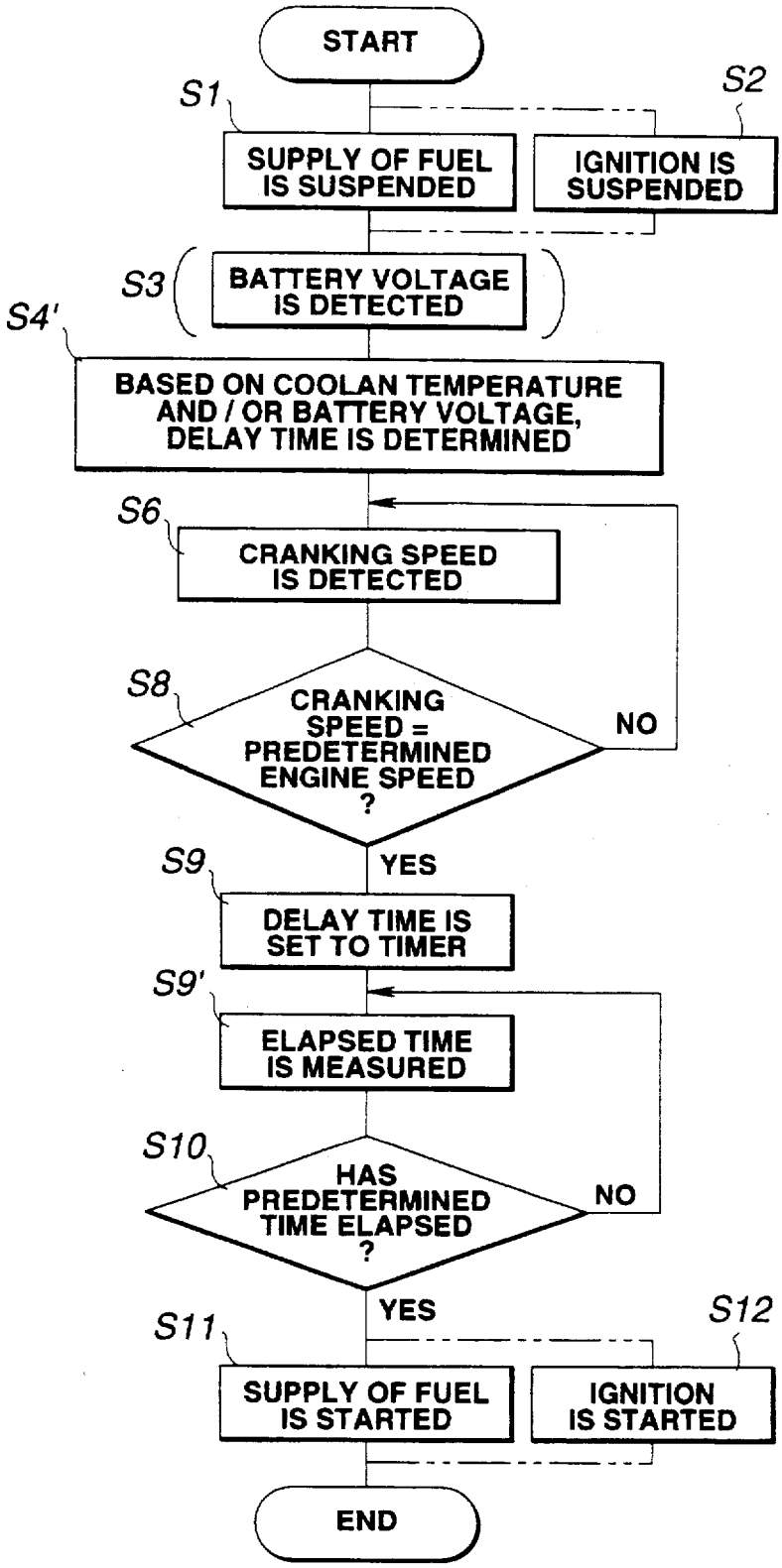

FIG. 12 shows such a control routine in which at steps S1 and S2 supply of fuel and ignition are in the condition of being suspended and at step S4' the delay time is determined. It will do that the delay time is so large that it becomes possible to judge such a case in which the cranking speed exceeds the predetermined engine speed momentarily, as a noise and exclude it from the input information for control. Such a delay time can be set in the timer set time memory 14*f*. At step S6 the cranking speed is detected, and when it is judged at step S8 that the cranking speed becomes the predetermined engine speed the delay time is set in the timer 12 at step S9 and the measurement of the delay time is executed at step S9'. When it is judged at step 10 that the delay time has elapsed, fuel supply and ignition by a spark plug are started at the steps S11 and S12.

In the meantime, the above described delay time is not set for the purpose of exclusion of noise but adjusted, by setting the predetermined engine speed to a fixed value, on the basis of the result of detection of the coolant temperature and battery voltage. By this, more delicate setting of a fuel supply timing in response to a variation of coolant temperature and battery voltage and therefore more accurate cold start control can be attained. For example, when considering the Table 1 for determination of the delay time in place of a predetermined engine speed, the delay time can be set relatively shorter in case, for example, the coolant temperature is low and the battery voltage is low or otherwise set relatively longer.

Figure 13:
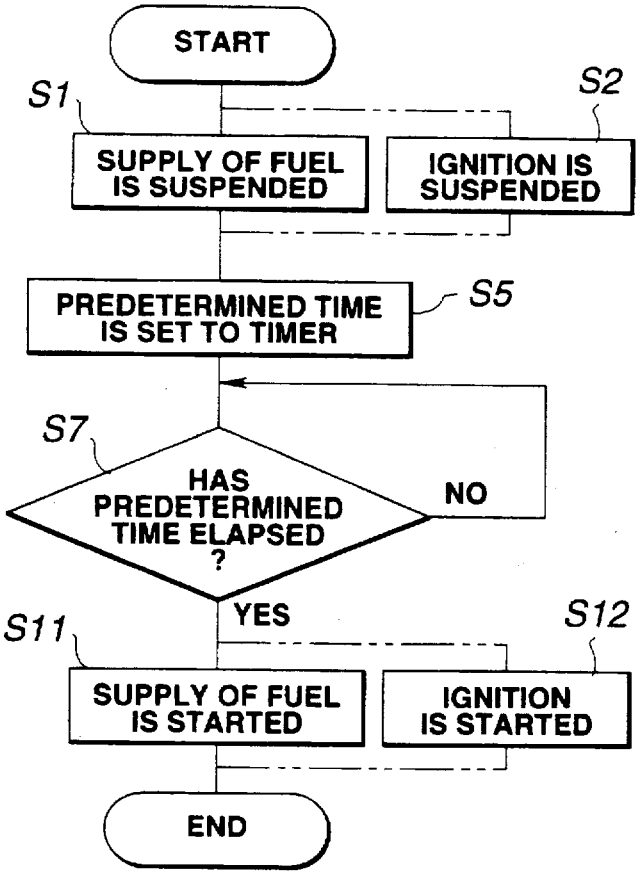

In the engine start control described above, judgment on whether the cranking speed has become the predetermined engine speed is made, but as shown in FIG. 13 the fuel supply starting timing can be set on the basis of only the time having elapsed from the beginning of cranking. That is, with respect to fuel supply and ignition which are both in a condition of being suspended at the steps S1 and S2, a predetermined time is set to the timer at the step S5. When it is judged at the step S7 that the predetermined time has elapsed, fuel supply and ignition are started at the steps S11 and S12, respectively. This control is adapted to determine the timing for starting fuel supply not on the basis of cranking speed but simply on the basis of the time having lapsed from the starting of cranking, so the control structure can be simpler.

In any event, as having described as above, fuel is not supplied immediately after the beginning of cranking but with a certain time lag or delay, which is effective for incomplete discharge or firing of the spark plug and undesirable sticking or attaching of fuel to the spark plugs, i.e., so-called wet fouling of the spark plugs, whereby it becomes possible to improve the start of an engine at low temperature.

While the present invention has been described and shown as being applied to a gasoline engine, it is not limited to such an engine but can be applied to a diesel engine to produce substantially the same effect.

What is claimed is:

1. A method of controlling start of an internal combustion engine, comprising:

detecting a coolant temperature of the engine;

detecting a cranking speed at start of the engine; and suspending supply of fuel to the engine, when said coolant temperature is equal to or lower than a predetermined value, until said cranking speed is equal to a predetermined value.

2. A method according to claim 1, wherein ignition in the engine is suspended until supply of fuel is started.

3. A method according to claim 1, wherein a cranking speed at which said supply of fuel is started is altered depending upon a variation of said coolant temperature in such a manner as to become lower as said coolant temperature becomes lower.

4. A method according to claim 1, further comprising detecting a voltage of a battery used for cranking the engine, a cranking speed at which said supply of fuel is started being altered in such a manner as to become lower as said voltage becomes lower, depending upon a variation of said voltage.

5. A method of controlling start of an internal combustion engine comprising:

detecting a coolant temperature of the engine:

detecting a cranking speed at start of the engine;

measuring a time from the beginning of said cranking;

suspending supply of fuel to the engine until a predetermined time elapses; and starting said supply of fuel after said predetermined time has elapsed.

6. A method of controlling start of an internal combustion engine comprising:

detecting a coolant temperature of the engine;

detecting a cranking speed at start of the engine;

measuring, when said coolant temperature is lower than a predetermined value, a time elapsing after said cranking speed has become a predetermined value;

suspending supply of fuel to the engine until a predetermined time elapses after said cranking speed has become a predetermined value; and starting said supply of fuel after said predetermined time has elapsed.

7. A device for controlling start of an internal combustion engine, comprising:

coolant temperature detecting means for detecting a coolant temperature of the engine;

cranking speed detecting means for detecting a cranking speed at start of the engine;

fuel supplying and suspending means for supplying fuel or suspending supply of fuel to the engine;

fuel supply controlling means for controlling said fuel supplying and suspending means in such a manner that supply of fuel to the engine is suspended, when said coolant temperature detected by said coolant temperature detecting means is lower than a predetermined temperature, until said cranking speed becomes a predetermined value.

8. A device according to claim 7, further comprising altering means for altering said predetermined cranking speed, said altering means altering said predetermined value on the basis of said coolant temperature detected by said coolant temperature detecting means in such a manner that said predetermined value of said cranking speed becomes lower as said coolant temperature becomes lower.

9. A device according to claim 7, further comprising ignition control means for controlling an ignition system of the engine, said ignition control means controlling said ignition system in such a manner that spark discharge by said ignition system is suspended during the time when said supply of fuel is suspended by said fuel supplying and suspending means, and is executed after said supply of fuel is started.

10. A device according to claim 7, further comprising battery voltage detecting means for detecting a voltage of a battery used for cranking of the engine, and altering means for altering said predetermined cranking speed at which said supply of fuel is started, said altering means altering said predetermined value of said cranking speed on the basis of said battery voltage detected by said battery voltage detecting means in such a manner that said predetermined value of said cranking speed becomes lower as said battery voltage becomes lower.

11. A device for controlling start of an internal combustion engine, comprising:

coolant temperature detecting means for detecting a coolant temperature of the engine;

cranking speed detecting means for detecting a cranking speed at start of the engine;

time measuring means for measuring, when said coolant temperature is lower than a predetermined value, a time elapsing after said cranking speed is equal to a predetermined value;

fuel supplying and suspending means for supplying fuel or suspending supply of fuel to the engine; and fuel supply controlling means for controlling said fuel supply and suspending means such that a supply of fuel to the engine is suspended, when said coolant temperature detected by said coolant temperature detecting means is lower than a predetermined temperature, until said time measured by said time measuring means becomes a predetermined value.

12. A device for controlling start of an internal combustion engine, comprising:

coolant temperature detecting means for detecting a coolant temperature of the engine;

cranking speed detecting means for detecting a cranking speed at start of the engine;

fuel supplying and suspending means for supplying fuel or suspending supply of fuel to the engine;

judgment means for judging, when said coolant temperature detected by said coolant temperature detecting means is lower than a predetermined value, whether said cranking speed is equal to a predetermined value;

delay time setting means for setting a delay time after said cranking speed has become a predetermined value; and fuel supply control means for controlling said fuel supplying and suspending means in such a manner that supply of fuel to the engine is suspended until said delay time elapses and started after said delay time has elapsed.

13. A device for controlling start of an internal combustion engine, comprising:

a coolant temperature detector for detecting an engine coolant temperature;

a crank speed detector for detecting an engine crank speed at start of the engine;

a fuel supplier for supplying fuel to the engine such that a supply of fuel to the engine is suspended, when the engine coolant temperature is lower than a predetermined temperature, until the engine crank speed is equal to a predetermined value.

14. A device for controlling start of an internal combustion engine, comprising:

a coolant temperature detector for detecting an engine coolant temperature;

a crank speed detector for detecting an engine crank speed at start of the engine;

a timer for measuring, when the coolant temperature is lower than a predetermined value, a time elapsing after the engine crank speed is equal to a predetermined value;

a fuel supplier for supplying fuel to the engine such that a supply of fuel to the engine is suspended, when the engine coolant temperature is lower than a predetermined temperature, until the elapsed time measured by the timer is equal to a predetermined value.

* * * * *